US007188972B2

(12) United States Patent
Chen

(10) Patent No.: US 7,188,972 B2
(45) Date of Patent: Mar. 13, 2007

(54) LAMP STRUCTURE

(75) Inventor: Yi-Yi Chen, Tainan (TW)

(73) Assignee: Innovative & Superior Technology Inc., Tainan (TW)

( * ) Notice: Subject to any disclaimer, the term of this patent is extended or adjusted under 35 U.S.C. 154(b) by 0 days.

(21) Appl. No.: 11/159,244

(22) Filed: Jun. 23, 2005

(65) Prior Publication Data

US 2006/0291208 A1 Dec. 28, 2006

(51) Int. Cl.
*F21V 5/04* (2006.01)

(52) U.S. Cl. ..... 362/268; 362/237; 362/332

(58) Field of Classification Search ..... 362/259, 362/237, 240, 244, 247, 268, 331, 332, 335, 362/336, 338, 340, 544, 545, 800
See application file for complete search history.

(56) References Cited

U.S. PATENT DOCUMENTS 3,396,344 A * 8/1968 Johnston ..... 362/259
4,306,278 A * 12/1981 Fulton et al. ..... 362/259
5,289,353 A * 2/1994 Sasajima et al. ..... 362/549
2002/0034081 A1 * 3/2002 Serizawa ..... 362/545

* cited by examiner

*Primary Examiner*—Y. My Quach-Lee
(74) *Attorney, Agent, or Firm*—Rosenberg, Klein & Lee

(57) ABSTRACT

A lamp includes several internal light emitting diodes, several first planoconvex lenses positioned over respective ones of light emitting ends of the light emitting diodes, and a second planoconvex lens; the second planoconvex lens is positioned over the first planoconvex lenses such that light emitted from the light emitting diodes will travel through the second planoconvex lens after passing through the first planoconvex lenses; because of focusing effect of the first and the second planoconvex lenses, light emitted from the light emitting diodes will become brighter, and the lamp will shine uniformly, and there will not be undesirable light dots present on the lamp.

1 Claim, 7 Drawing Sheets

LAMP STRUCTURE

BACKGROUND OF THE INVENTION

1. Field of the Invention

The present invention relates to a lamp, more particularly one, which includes light emitting diodes, first planoconvex lenses positioned over light emitting ends of the light emitting diodes, and a second planoconvex lens positioned over the first planoconvex lenses such that light emitted from the light emitting diodes will become brighter, and the lamp will shine uniformly, and there will not be undesirable light dots shown on the lamp.

2. Brief Description of the Prior Art

Referring to FIG. 1, a conventional lamp 10 includes a base 101, several light emitting diodes 102 in the base 101, and a transparent cover 103 joined to the base 101 to cover the light emitting diodes 102. The transparent cover 103 protects the light emitting diodes 102, but it can not help increase brightness of the lamp 10. There is another form of cover (not shown) for the lamp 10, which is formed with several continuous refracting sides each facing one of the light emitting ends of the light emitting diodes 102; thus, light from the light emitting diodes 102 will be refracted in various desired directions. However, brightness of the lamp will not be significantly increased. And, when the light emitting diodes 102 are powered, very obvious undesirable light dots (white dots) will be present on the lamp, as shown in FIG. 2.

The present applicant taught "Lamp With Light Emitting Diodes" in U.S. patent application, and was granted U.S. Pat. No. 6,731,053 accordingly. The lamp includes a base, light emitting diodes and a transparent covering unit. The base has a convexly curved surface. The transparent covering unit has a convexly curved surface on a first side, and several flat sections on an opposite second side, which is faced with the convexly curved surface of the base. The light emitting diodes are arranged on the convexly curved surface of the base to be each perpendicular to a corresponding one of the flat sections; thus, when light emitted from the light emitting diodes passes through the transparent covering unit, it will be refracted to focus, and the lamp will be brighter.

However, there will also be obvious undesirable light dots (white dots) present on the lamp.

SUMMARY OF THE INVENTION

It is a main object of the invention to provide an improvement on a lamp to overcome the above-mentioned problem. The lamp of the present invention includes several light emitting diodes, several first planoconvex lenses positioned over light emitting ends of the light emitting diodes, and a second planoconvex lens; the second planoconvex lens is positioned over the first planoconvex lenses such that light emitted from the light emitting diodes will travel through the second planoconvex lens after passing through the first planoconvex lenses. Because of focusing effect of the first and the second planoconvex lenses, light emitted from the light emitting diodes will become brighter, and the lamp will shine uniformly, and there will not be undesirable light dots present on the lamp.

BRIEF DESCRIPTION OF THE DRAWINGS

The present invention will be better understood by referring to the accompanying drawings, wherein.

DETAILED DESCRIPTION OF THE PREFERRED EMBODIMENTS

Figure 1:
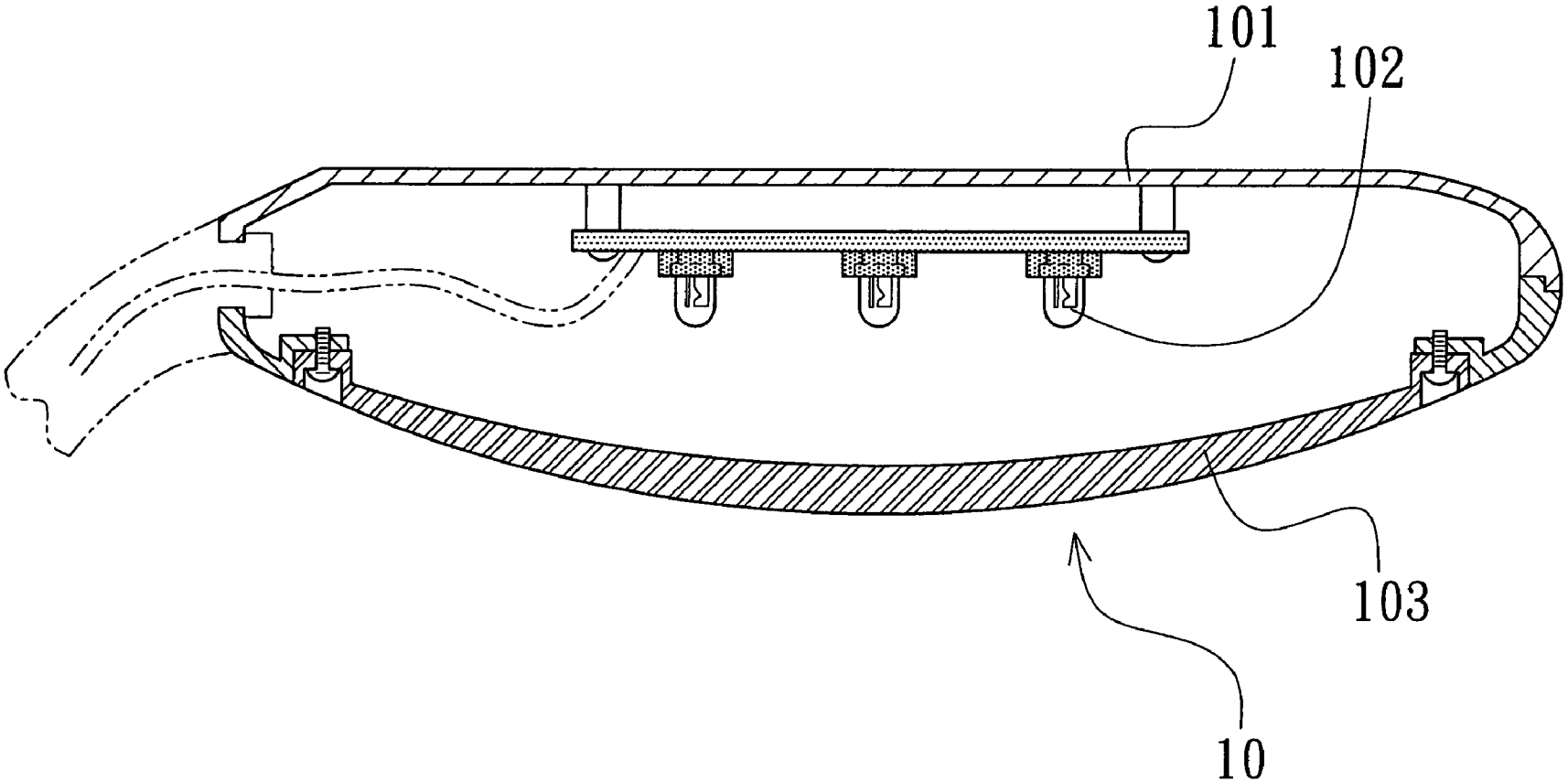
FIG. 1 (PRIOR ART)
FIG. 1 is a sectional view of the conventional lamp.
Figure 2:
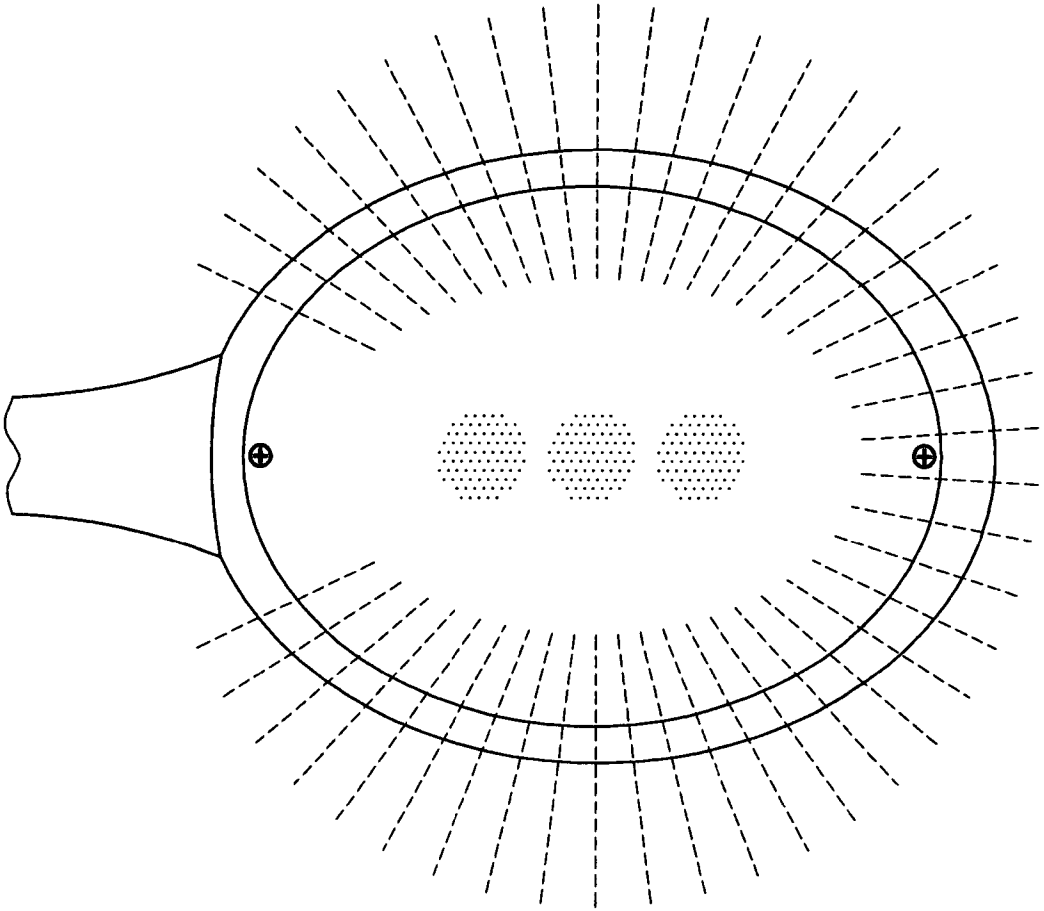
FIG. 2 (PRIOR ART)
FIG. 2 is a top view of the conventional lamp, shining.
Figure 3:
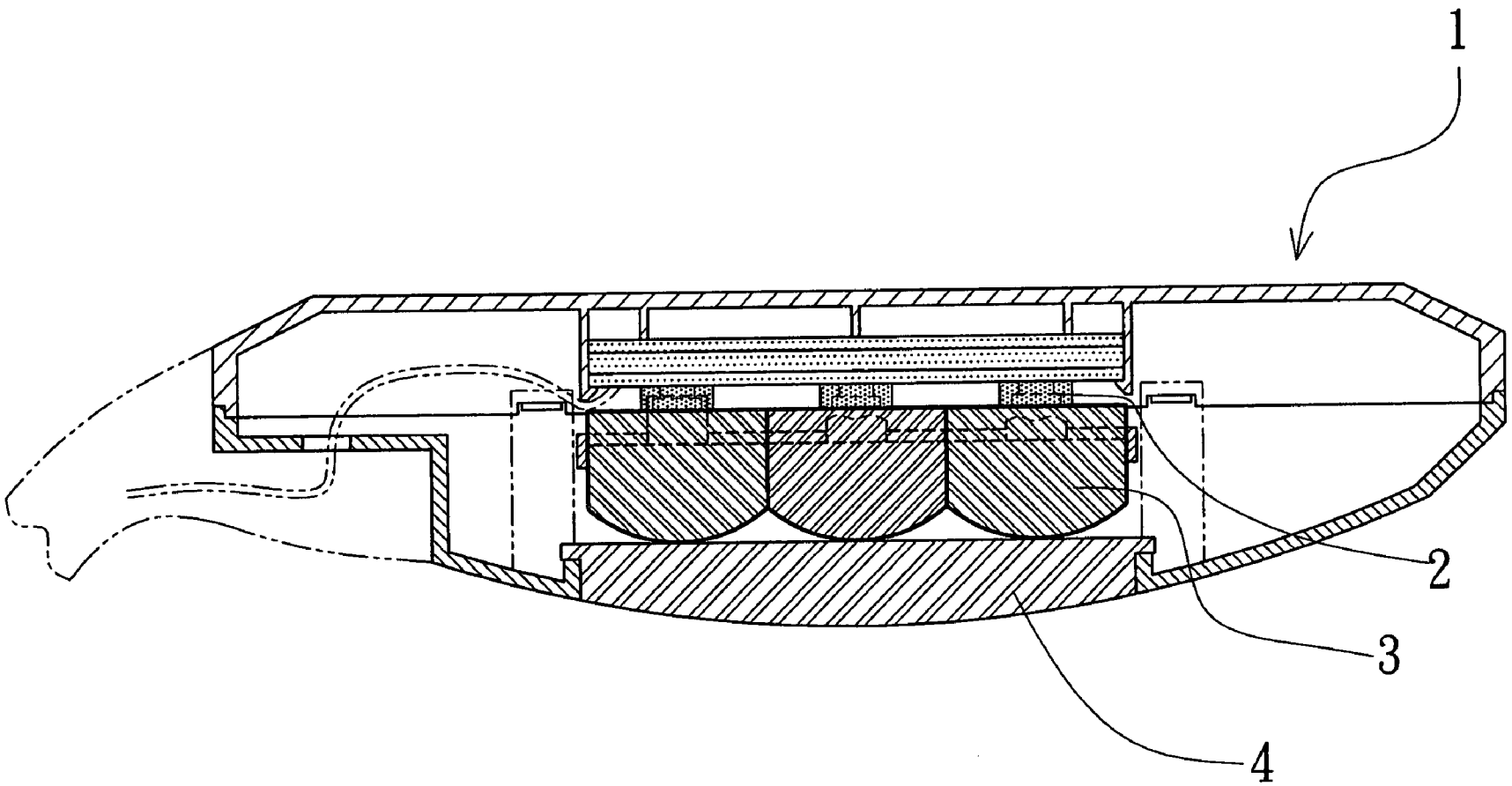
FIG. 3 is a sectional view of the first preferred embodiment of a lamp according to the present invention.
Figure 4:
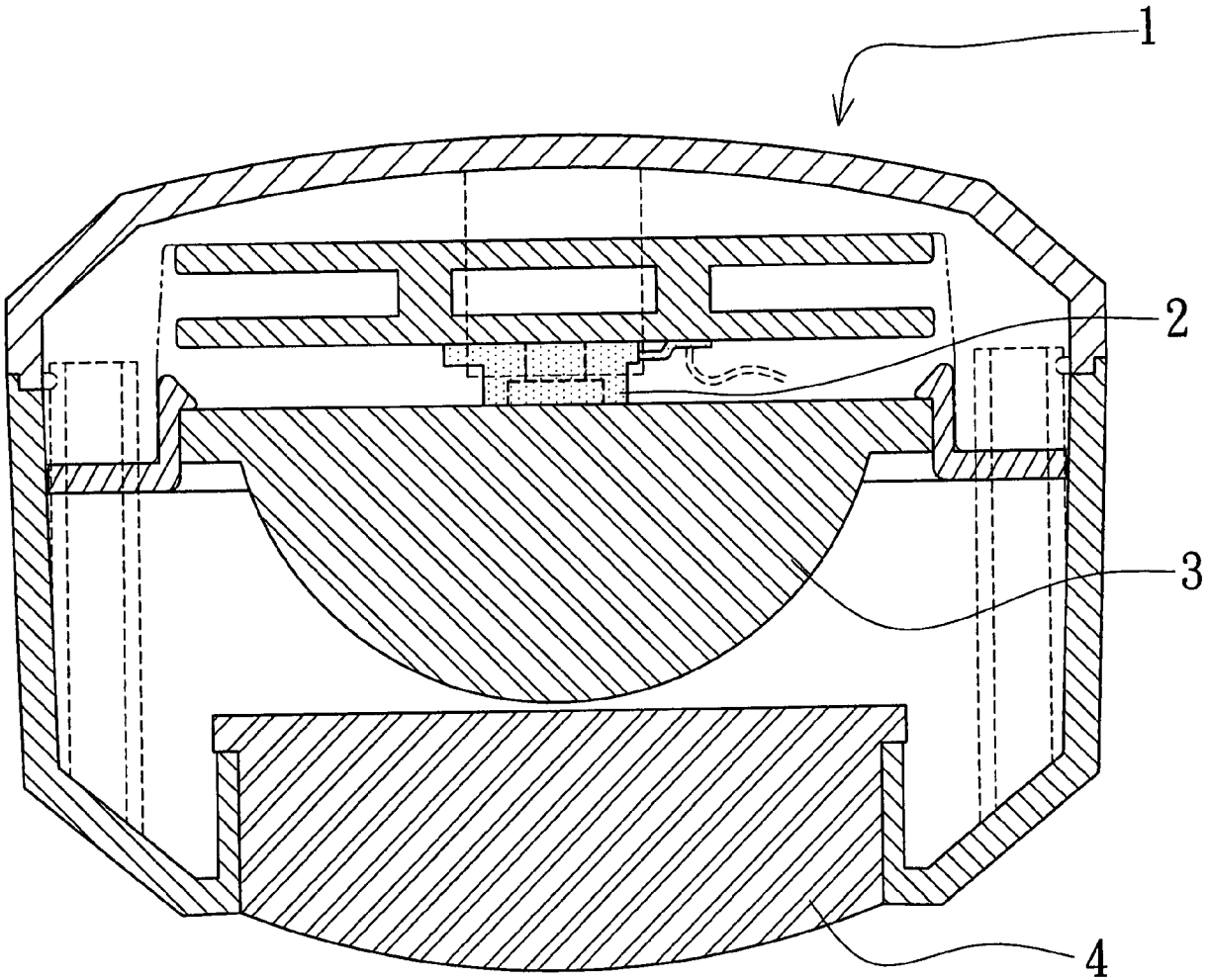
FIG. 4 is another sectional view of the first preferred embodiment.

Referring to FIGS. 3 and 4, a first preferred embodiment of a lamp in the present invention includes a shell 1, three light emitting diodes 2 in the shell 1, three first planoconvex lenses 3, and a second planoconvex lens 4. The first planoconvex lenses 3 are positioned over respective ones of light emitting ends of the light emitting diodes 2. And, the second planoconvex lens 4 is positioned over the first planoconvex lenses 3 such that light emitted from the light emitting diodes 2 will travel through the second planoconvex lens 4 after passing through the first planoconvex lenses 3.

Thus, when the light emitting diodes 2 are powered, light emitted from the light emitting diodes 2 will travel outside to provide illumination, first through the first planoconvex lenses 3, and then through the second planoconvex lens 4.

Figure 5:
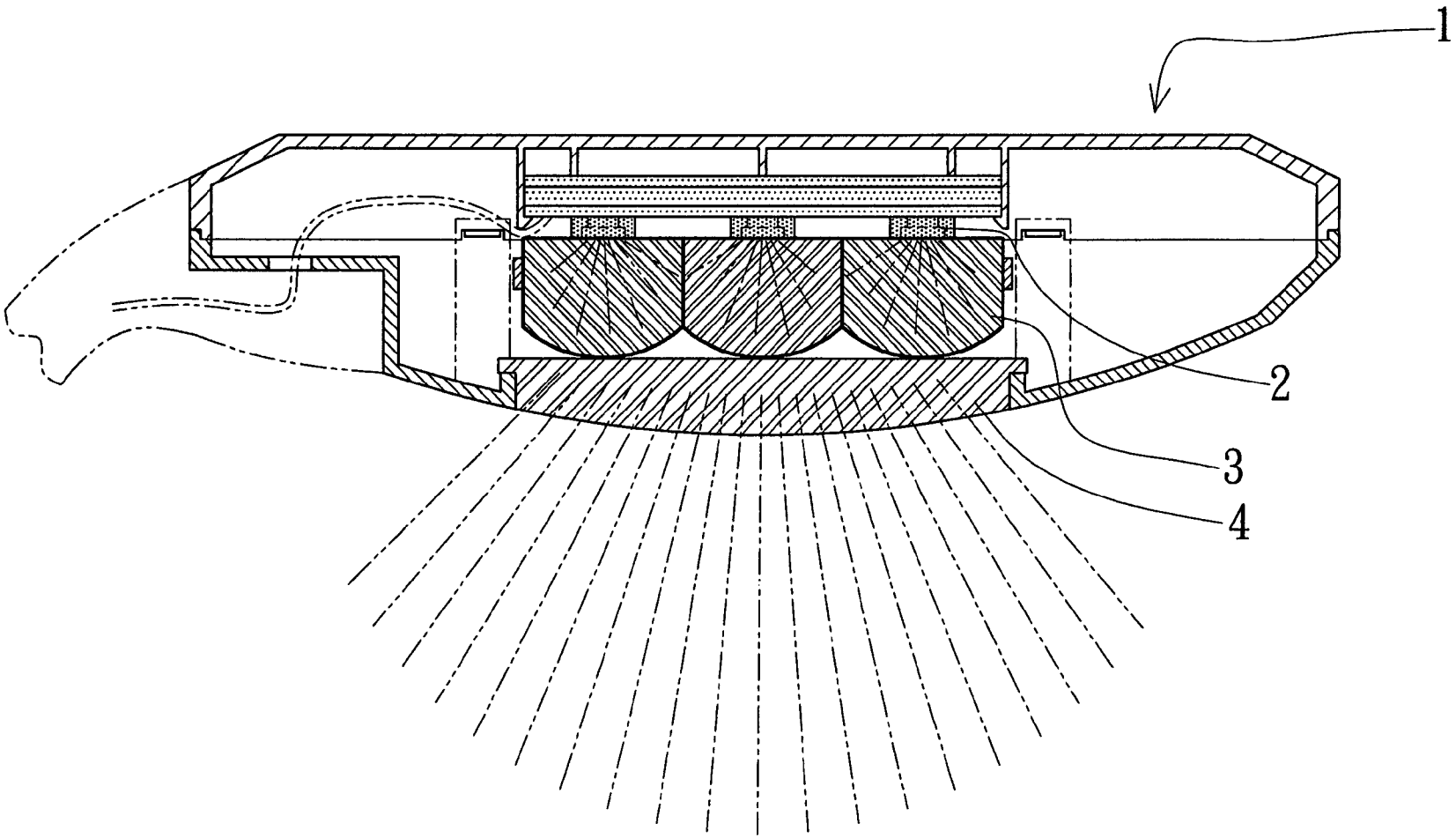
FIG. 5 is a front view of the first embodiment, shining.

Referring to FIG. 5, light emitted from each of the light emitting diodes 2 will become brighter because of focusing effect of the corresponding first planoconvex lens 3. The light traveling from the first planoconvex lenses 3 will become even brighter because of focusing effect of the second planoconvex lens 4 after traveling through the second planoconvex lens 4. And, the light will also shine uniformly. Therefore, there will not be any light dot (white dot) present on the present lamp.

Figure 6:
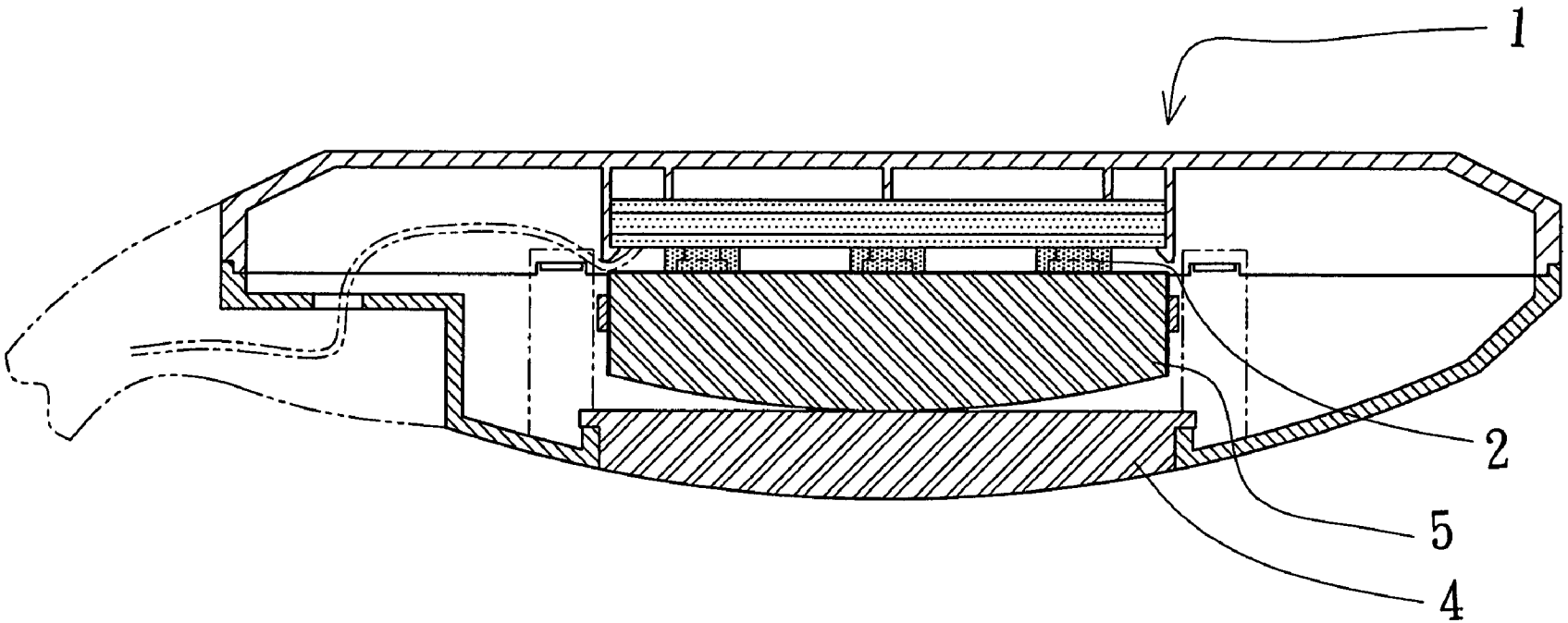
FIG. 6 is a sectional view of the second preferred embodiment.

Referring to FIG. 6, a second preferred embodiment of a lamp in the present invention includes a shell 1, several light emitting diodes 2 in the shell, a first planoconvex lens 3, and a second planoconvex lens 4. The first planoconvex lens 3 is positioned over light emitting ends of the light emitting diodes 2. And, the second planoconvex lens 4 is positioned over the first planoconvex lens 3 such that light emitted from the light emitting diodes 2 will travel through the second planoconvex lens 4 after passing through the first planoconvex lens 3. Thus, light from the lamp will be brighter because of focusing effect of the first and the second planoconvex lenses 3 and 4, and there will not be any light dot (white dot) present on the present lamp.

Figure 7:
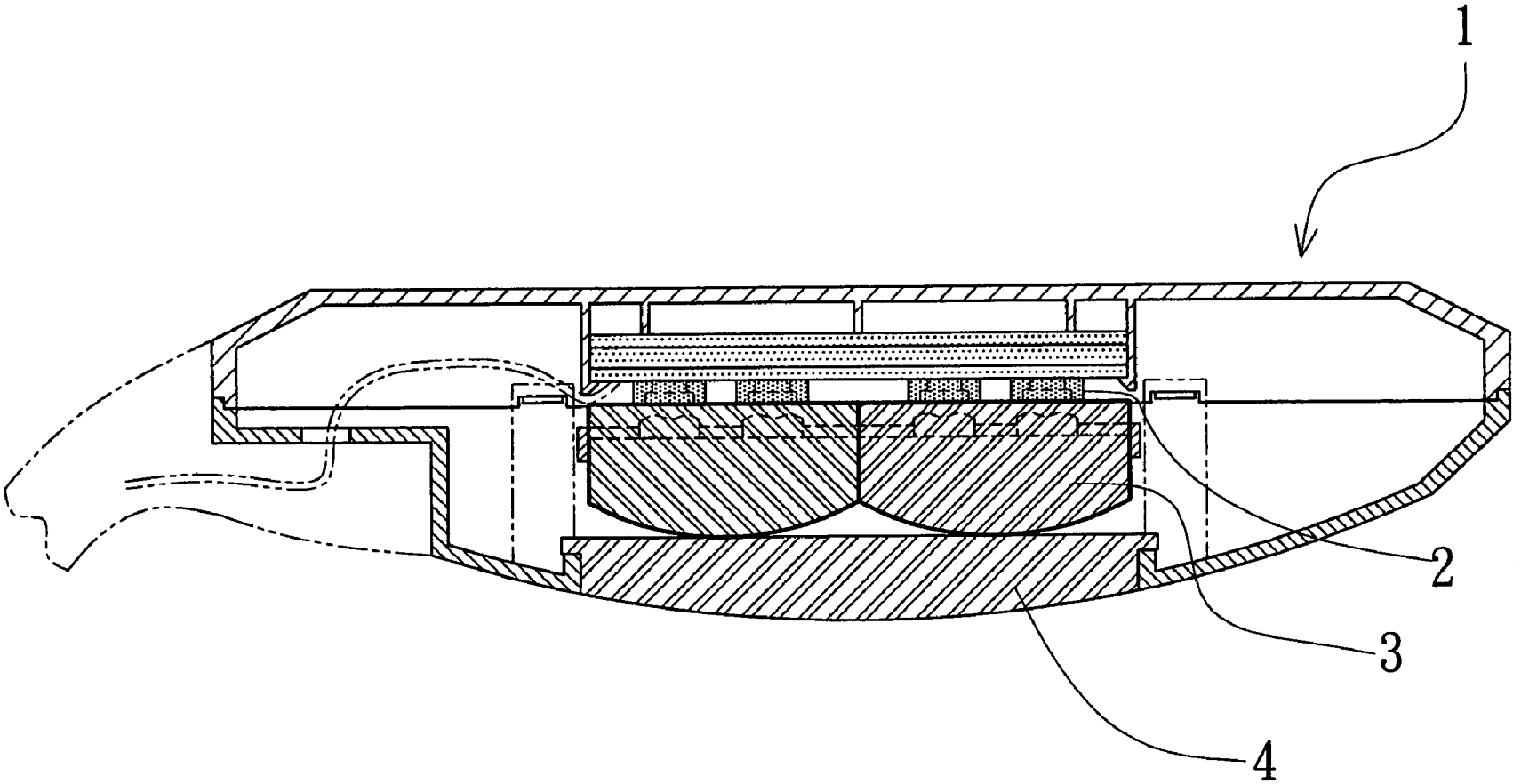
FIG. 7 is a sectional view of the third preferred embodiment.

Referring to FIG. 7, a third preferred embodiment of a lamp in the present invention includes a shell 1, several light emitting diodes 2 in the shell, several first planoconvex lenses 3, and a second planoconvex lens 4. The first planoconvex lenses 3 are each positioned over plural ones of light emitting ends of the light emitting diodes 2. And, the second planoconvex lens 4 is positioned over the first planoconvex lenses 3 such that light emitted from the light emitting diodes 2 will travel through the second planoconvex lens 4 after passing through the first planoconvex lenses 3. Thus, light from the lamp will be brighter because of focusing effect of the first and the second planoconvex lenses 3 and 4, and there will not be any light dot (white dot) present on the present lamp.

What is claimed is:

1. A lamp comprising;

a plurality of internal light emitting diodes; the light emitting diodes each having a light emitting end;

a single second planoconvex lens having a flat surface on one side and an opposing convex surface, said second planoconvex lens covering the light emitting ends of the internal light emitting diodes for focusing light emitted from the light emitting diodes; and a single first planoconvex lens having a flat surface on one side and an opposing convex surface, said single first planoconvex lens positioned over said plurality of light emitting diodes, said flat surface of said single first planoconvex lens being adjacent said light emitting end of said plurality of light emitting diodes.

* * * * *